US008016282B2

(12) United States Patent
Purcell et al.

(10) Patent No.: US 8,016,282 B2
(45) Date of Patent: Sep. 13, 2011

(54) TRANSPORT FOR SINGULATING ITEMS

(75) Inventors: David W. Purcell, New Milford, CT (US); Steven J. Dacunha, West Hartford, CT (US); Richard F. Stengl, Waterbury, CT (US)

(73) Assignee: Pitney Bowes Inc., Stamford, CT (US)

( * ) Notice: Subject to any disclaimer, the term of this patent is extended or adjusted under 35 U.S.C. 154(b) by 182 days.

(21) Appl. No.: 12/239,021

(22) Filed: Sep. 26, 2008

(65) Prior Publication Data

US 2010/0013142 A1 Jan. 21, 2010

Related U.S. Application Data

(60) Provisional application No. 61/015,872, filed on Dec. 21, 2007.

(51) Int. Cl.
*B65H 5/00* (2006.01)

(52) U.S. Cl. ..... 271/10.01; 271/124; 271/121; 271/104

(58) Field of Classification Search ..... 271/10.01, 271/104, 121, 124
See application file for complete search history.

(56) References Cited

U.S. PATENT DOCUMENTS 4,171,130 A * 10/1979 Jeschke et al. ..... 271/10.03
4,691,912 A * 9/1987 Gillmann ..... 271/10.02
4,893,804 A * 1/1990 Sasage et al. ..... 271/3.09
4,978,114 A 12/1990 Holbrook
5,074,540 A 12/1991 Belec et al.
5,178,224 A * 1/1993 DiGiulio et al. ..... 177/25.15
5,238,236 A 8/1993 Belec et al.
5,409,204 A 4/1995 Strohmeyer et al.
5,443,359 A * 8/1995 Miller et al. ..... 414/798.9
5,730,439 A 3/1998 Salomon et al.
6,003,857 A 12/1999 Salomon et al.
6,135,441 A 10/2000 Belec et al.
6,170,816 B1 * 1/2001 Gillmann et al. ..... 271/10.03
6,554,275 B1 * 4/2003 Tranquilla ..... 271/259
7,296,794 B2 * 11/2007 Shimazaki ..... 271/259
7,611,139 B2 * 11/2009 Purcell et al. ..... 271/10.01
7,611,141 B2 * 11/2009 Williams et al. ..... 271/124
2004/0056410 A1 * 3/2004 Skadow et al. ..... 271/10.01
2005/0067765 A1 3/2005 Watanabe et al.
2006/0017216 A1 * 1/2006 Mitsuya et al. ..... 271/121
2007/0102869 A1 5/2007 Fairweather et al.
2007/0126171 A1 * 6/2007 Takeuchi et al. ..... 271/121
2007/0132178 A1 6/2007 Marcinik et al.
2007/0284807 A1 12/2007 Lyga et al.
2008/0099977 A1 5/2008 Salomon et al.

* cited by examiner

*Primary Examiner* — Stefanos Karmis
*Assistant Examiner* — Howard Sanders
(74) *Attorney, Agent, or Firm* — Michael J. Cummings; Charles R. Malandra, Jr.; Steven J. Shapiro

(57) ABSTRACT

A method of singulating overlapping items includes receiving the overlapping items in a singulation device, the device including a first transport element configured for rotation in a first direction and a second transport element in opposing relation to the first transport element, wherein the second transport element is configured for rotation in a second direction opposite to the first direction. The method further includes rotating the first transport element at a first transport speed, rotating the second transport element at a second transport speed substantially equal to the first transport speed, conveying the overlapping items between the transport elements along a transport path, decreasing the second transport speed to singulate the overlapping items, decreasing the first transport speed to reduce a speed of a lead item, and transporting the lead item away from the singulation device.

25 Claims, 4 Drawing Sheets

TRANSPORT FOR SINGULATING ITEMS

CROSS REFERENCE TO RELATED APPLICATIONS

The benefit of priority is claimed under 35 U.S.C. 119(e) of U.S. Provisional Patent Application No. 61/015,872 filed Dec. 21, 2007, entitled "SINGULATION DETECTION IN MIXED MAIL FEEDER," which is incorporated by reference herein in its entirety.

FIELD OF THE INVENTION

The present invention relates to a transport for handling items for processing and, more particularly, to a method of singulating items.

BACKGROUND OF THE INVENTION

Item transport systems, such as mailpiece handling systems, for example, are known in the art. These systems include inserter systems, which create mailpieces and prepare them for mailing, as well as sortation systems, which sort completed mailpieces and direct the mailpieces to storage pockets or bins, depending on the system's configuration. Sortation of mailpieces may be carried out either prior to mailing (i.e., outsorting) or upon receipt from a postal carrier (i.e., insorting). Other types of transport systems and related applications are known.

In some mailpiece handling systems, mailpieces are transported using belts or chain drives between stations where they undergo various types of processing. The processing may include cutting, folding, scanning, weighing, printing, and labeling, for example.

Some systems are configured to process mailpieces of different sizes and/or different types. In one example, a mailpiece handling system may be configured to process envelopes of different sizes. Other systems may be configured to process different types of mailpieces, such as envelopes, postcards, magazines, and catalogs, for example.

Many of the processing steps implemented by mailpiece handling systems require precise spacing between mailpieces and orientation of the respective mailpieces. Control of the mailpieces may be applied at various points in a typical mailpiece handling system, including at the infeed portion, as well as on the transports that move mailpieces between the various processing stations.

Difficulties with mailpiece control may be encountered in systems that handle mailpieces of different sizes and/or different types, as discussed above. In a further complicating factor, the various items may be provided with different wrapping materials, ranging from no wrapping material in the case of envelopes to polymer coverings in the case of magazines, for example. These difficulties add to the complexity of mailpiece handling systems and decrease their reliability.

SUMMARY OF EXEMPLARY ASPECTS

In the following description, certain aspects and embodiments of the present invention will become evident. It should be understood that the invention, in its broadest sense, could be practiced without having one or more features of these aspects and embodiments. It should also be understood that these aspects and embodiments are merely exemplary.

In accordance with the purpose of the invention, as embodied and broadly described herein, one aspect of the invention relates to a method of singulating overlapping items comprising receiving the overlapping items in a singulation device. The singulation device may comprise a first transport element configured for rotation in a first direction and a second transport element in opposing relation to the first transport element. In one embodiment, the second transport element is configured for rotation in a second direction opposite to the first direction.

The method of singulating may further comprise rotating the first transport element at a first transport speed, rotating the second transport element at a second transport speed substantially equal to the first transport speed, conveying the overlapping items between the transport elements along a transport path, decreasing the second transport speed to singulate the overlapping items, decreasing the first transport speed to reduce a speed of a lead item, and transporting the lead item away from the singulation device.

In another embodiment, the method further comprises increasing the first transport speed to advance a subsequent item, and transporting the subsequent item away from the singulation device at a predetermined pitch with respect to the lead item.

As used herein, "items" include papers, documents, postcards, envelopes, brochures, enclosures, booklets, magazines, media items, including CDs, DVDs, computer disks, and/or other digital storage media, and packages having a range of sizes and materials. The items may be unwrapped or may be covered with a wrapping material such as paper, a polymer wrap, such as polyethylene, for example, or other wrapping material.

Further, as used herein, "singulate" means separate along the transport path so that the items have no overlapping portion.

Still further, as used herein, "pitch" means the distance along the transport path from the leading edge of a downstream item (e.g., the lead item) to the leading edge of an upstream item (e.g., the subsequent item). Thus, pitch includes the length of an item and the space between that item and a subsequent item.

In another aspect, the invention relates to a method of singulating overlapping items comprising receiving the overlapping items in a singulation device. In some embodiments, the singulation device may comprise a first transport element configured for rotation in a first direction and a second transport element in opposing relation to the first transport element. The second transport element may be configured for rotation in a second direction opposite to the first direction.

The method of singulating may further comprise rotating the first transport element at a first transport speed, rotating the second transport element at a second transport speed substantially equal to the first transport speed, conveying the overlapping items between the transport elements along a transport path, detecting a position of a leading edge of a lead item along the transport path, decreasing the second transport speed based on the position of the leading edge to singulate the overlapping items, decreasing the first transport speed to reduce a speed of the lead item, and transporting the lead item away from the singulation device.

In some embodiments, the method of singulating may further comprise increasing the first transport speed to a modified first transport speed based on the position of the lead item and a position of a subsequent item to advance the subsequent item, decreasing the first transport speed to reduce a speed of the subsequent item, and transporting the subsequent item away from the singulation device at a predetermined pitch with respect to the lead item.

In yet another aspect, the invention relates to a device for singulating overlapping items, comprising a singulation device for receiving the overlapping items, the singulation device comprising a first transport element configured for rotation in a first direction and a second transport element in opposing relation to the first transport element, wherein the second transport element is configured for rotation in a second direction opposite to the first direction. The device for singulating may further comprise a controller operatively connected to the first transport element and the second transport element.

In one embodiment, the controller is configured to rotate the first transport element at a first transport speed, rotate the second transport element at a second transport speed substantially equal to the first transport speed, so as to convey the overlapping items between the transport elements along a transport path, decrease the second transport speed to singulate the overlapping items, decrease the first transport speed to reduce a speed of a lead item, and activate a transport nip to transport the lead item away from the singulation device.

Aside from the structural and procedural arrangements set forth above, the invention could include a number of other arrangements, such as those explained hereinafter. It is to be understood that both the foregoing description and the following description are exemplary only.

BRIEF DESCRIPTION OF THE DRAWINGS

The accompanying drawings, which are incorporated in and constitute a part of this specification, illustrate several exemplary embodiments of the invention and, together with the description, serve to explain the principles of the invention. In the drawings.

DETAILED DESCRIPTION OF EXEMPLARY EMBODIMENTS

Reference will now be made in detail to exemplary embodiments of the invention, examples of which are illustrated in the accompanying drawings. Wherever possible, the same reference numbers will be used throughout the drawings to refer to the same or like parts.

Embodiments of the method according to the invention are described with reference to certain applications in mailpiece sortation systems. It should be understood, however, that the method of the invention may be used in association with other systems configured to handle and transport items. Further, many sortation systems are modular and may include more or fewer modules than those described herein based on the particular application.

Figure 1:
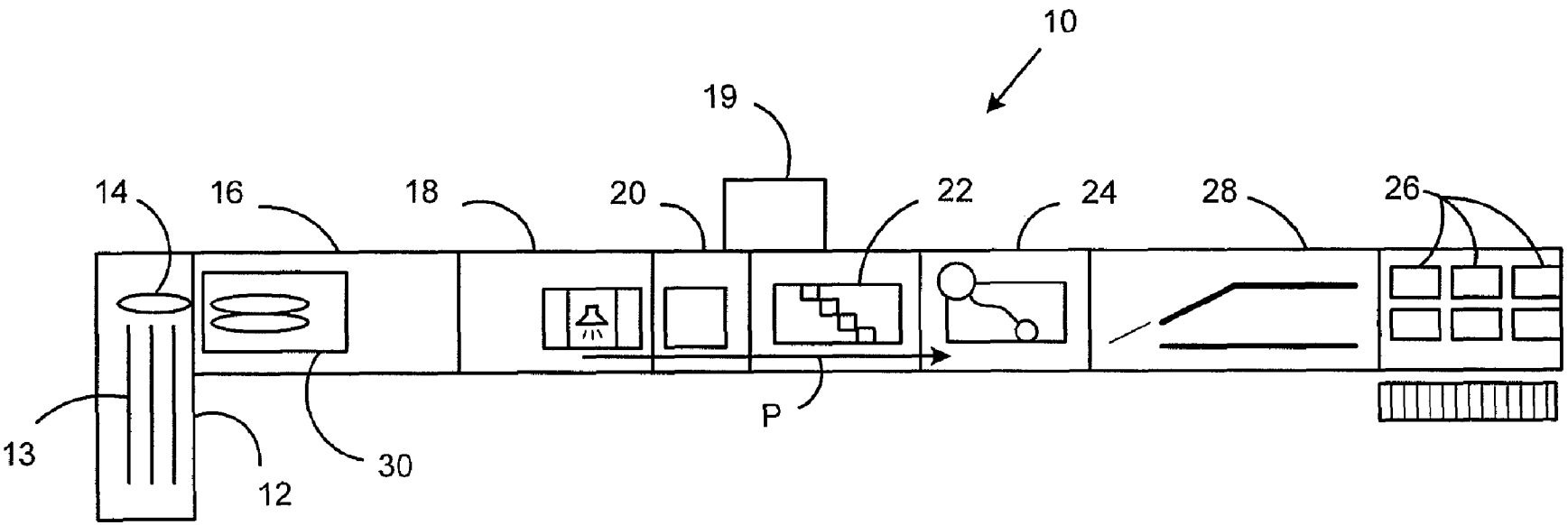
FIG. 1 is a block diagram of a sortation system incorporating an item singulation device for carrying out embodiments of the method according to the invention.

A sortation system 10 for implementing the method of singulating overlapping items according to embodiments of the invention is shown in FIG. 1. The sortation system 10 includes a feeder module 12 for feeding items for sortation. In one embodiment, the items are arranged on the feeder on edge and advanced using a conveyor 13, for example, towards a feeder belt 14, shown schematically in FIG. 1. Other feeding arrangements may also be used.

In this embodiment, the feeder belt 14 is configured to contact a surface of an approaching item and to redirect the item's direction of travel substantially perpendicularly to advance the item for downstream processing. The feeder belt 14 may feed a single item at a time. Often, however, contact between items causes multiple items to advance. The multiple items may be overlapping to various degrees.

From the feeder module 12, the items are fed to a singulation module 16, which singulates the overlapping items to ensure that only one item at a time is processed by the system. The singulated items are fed along a transport path P for processing by various modules. As discussed above, many item processing systems, such as mailpiece handling systems, for example, optimally process items that are spaced apart at a predetermined pitch.

The items first pass through a scanning module 18, where an image of at least a portion of each item is obtained. The scanned image may be used by the controller 19 to determine the destination pocket for the item. As discussed above, bins may also be used, depending on the configuration of the sortation system. In the illustrated sortation system 10, the items then pass through a weighing module 20, where the weight of the item is obtained.

In some applications, a sortation system is used to apply markings, such as an address or code, for example, to the face of items being processed. Such markings may be added using a printer or labeler. Both a printing module 22 and a labeling module 24 are included in the illustrated sortation system 10.

Finally, the items are directed to the destination pocket 26 using a diverter module 28 in the transport path P. For systems with pockets 26 on multiple levels, an elevator arrangement (not shown) may be used to move the items to the appropriate level.

The singulation module 16 of the sortation system 10 comprises a singulation device 30, which implements a method of singulating overlapped items according to embodiments of the invention and feeds the singulated items along the transport path P at a predetermined pitch for processing by the other modules of the system 10.

Figure 2:
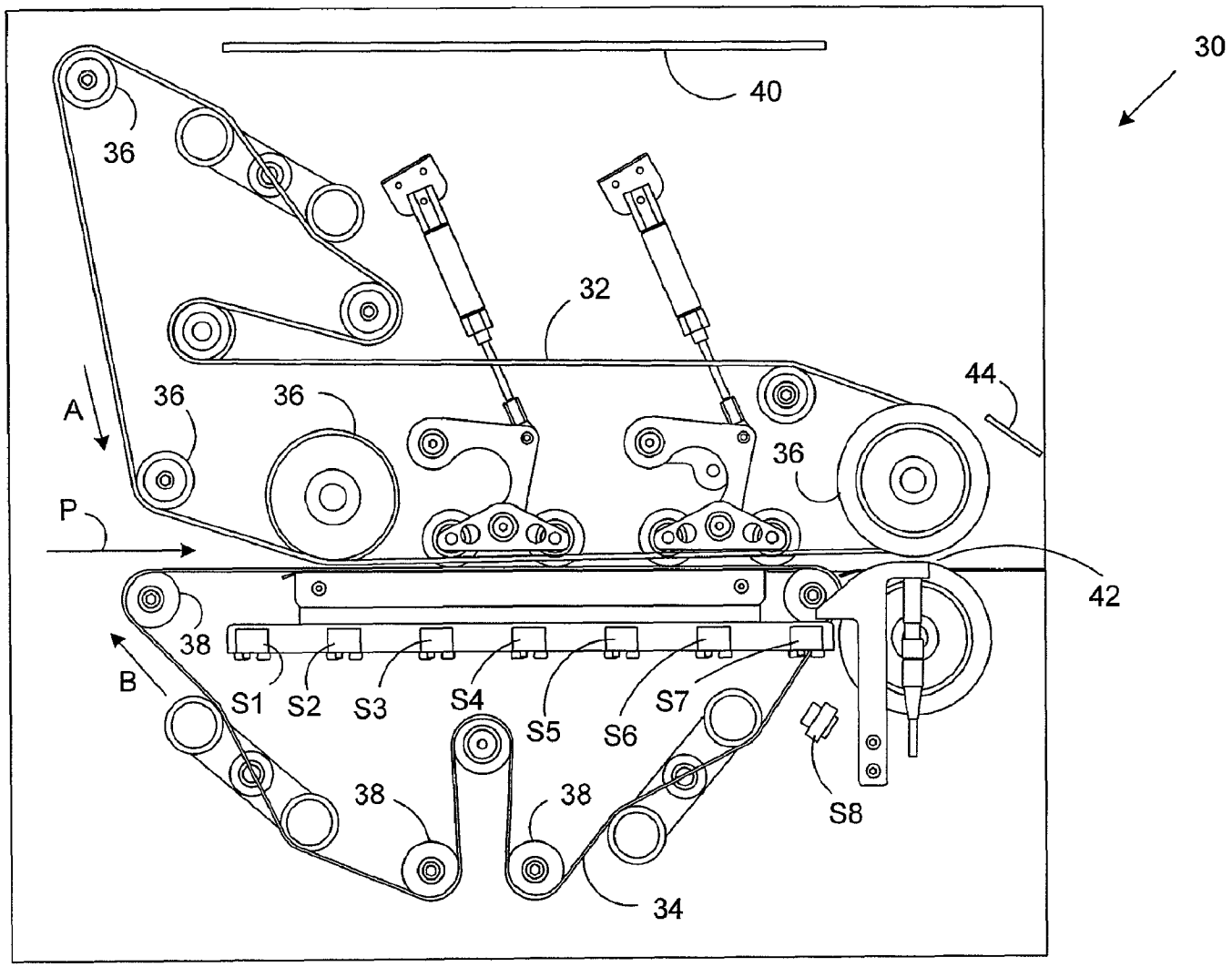
FIG. 2 is a plan view of an item singulation device for carrying out embodiments of the method according to the invention.

An embodiment of the singulation device 30 is shown in FIG. 2. As shown, the singulation device 30 comprises a first transport element 32 configured for rotation in a first direction, indicated at arrow A in FIG. 2, and a second transport element 34 in opposing relation to the first transport element 32. The second transport element 34 is configured for rotation in a second direction, indicated at arrow B in FIG. 2, opposite to the first direction. The transport elements 32, 34 are driven by the controller 19 in a manner described below.

In the illustrated embodiment, the first transport element 32 comprises a single flat belt disposed on a plurality of smooth first transport rollers 36. Alternatively, the first transport element may comprise a plurality of belts, for example. In further embodiments, the first transport element may comprise O-rings driven with rollers, toothed belts driven with pulleys, chains driven with sprockets, or other drive combinations. Similarly, the illustrated second transport element 34 comprises a single flat belt disposed on a plurality of smooth second transport rollers 38. Alternatively, the second transport element 34 may comprise a plurality of belts or other drive combinations, as discussed above.

The first and second transport elements 32, 34 receive overlapping items from the feeder module 12 and convey the items along the transport path P. A biasing force may be applied to maintain the transport elements 32, 34 in contact while conveying varying numbers of overlapping items.

As shown in FIG. 2, a plurality of sensors, comprising an upstream sensor S1, a downstream sensor S7, and a plurality of intermediate sensors S2-S6, are arranged along the transport path P proximate to the second transport element 34 for detecting a position of respective items. In the illustrated embodiment, the sensors are spaced at intervals of approximately two inches, but other arrangements may also be used.

In the illustrated embodiment, the sensors S1-S7 comprise photocells. A reflector element 40 is disposed opposite to the plurality of sensors proximate to the first transport element 32. Other types and arrangements of sensors may also be used. For example, the sensors may alternatively be disposed proximate to the first transport element 32. The sensors provide an indication to the controller 19 of the position of an item on the transport path P. Seven sensors are illustrated in the embodiment shown in FIG. 2. Other numbers of sensors may also be used.

In the illustrated embodiment, the singulation device 30 further comprises a transport nip 42 that transports singulated items away from the singulation device 30 for further downstream processing, for example.

A nip sensor S8 is provided upstream of the transport nip 42. In the illustrated embodiment, the nip sensor S8 comprises a photocell. A reflector element 44 is disposed opposite to the nip sensor S8. Other types and arrangements of sensors may also be used. The nip sensor S8 provides an indication to the controller 19 that an item has been engaged by the transport nip 42.

An embodiment of the method according to the invention will now be described with reference to FIGS. 3A-3E.

Figure 3A:
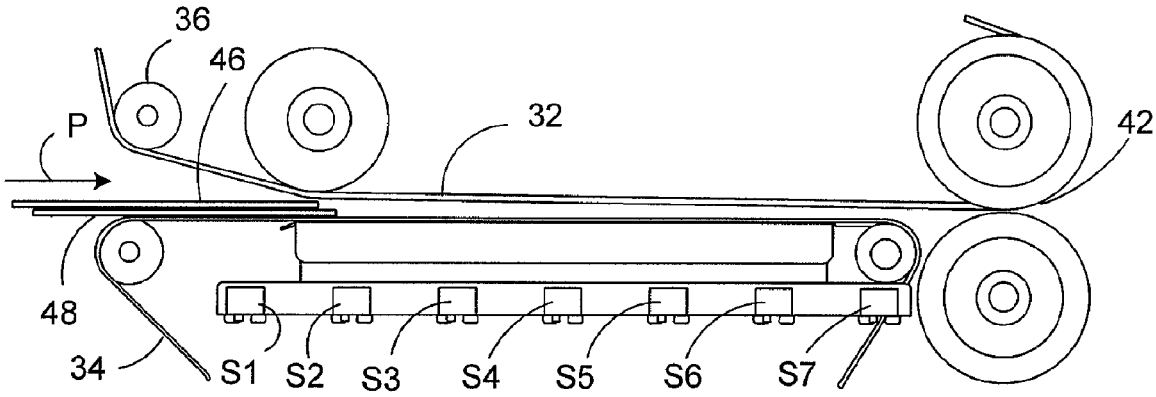
FIGS. 3A-3E are partial schematic views illustrating an embodiment of the method according to the invention.

According to one embodiment, the method of singulating overlapping items 46, 48 comprises receiving the overlapping items in a singulation device 30, as shown in FIG. 3A. As discussed above, the feeder belt 14 may feed multiple overlapping items into the singulation device 30 of the singulation module 16. The multiple overlapping items may comprise two or more items. Embodiments of the invention will be discussed with reference to singulating two overlapping items, but embodiments of the method of the invention may be applied to different numbers of overlapping items.

Figure 3B:
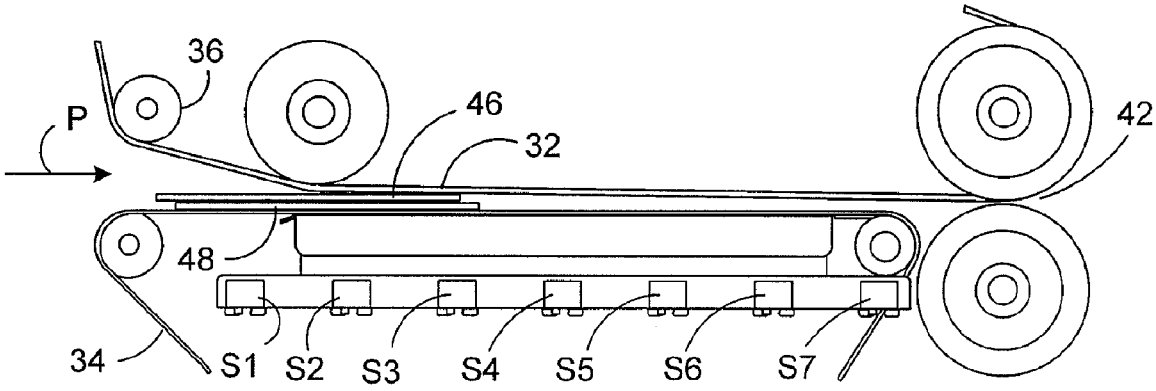

The method of singulating overlapping items according to this embodiment further comprises rotating the first transport element 32 at a first transport speed, rotating the second transport element 34 at a second transport speed substantially equal to the first transport speed, and conveying the overlapping items between the transport elements 32, 34 along a transport path P, as shown in FIG. 3B. In one example, the first transport speed and the second transport speed are approximately 30 inches per second.

Figure 3C:
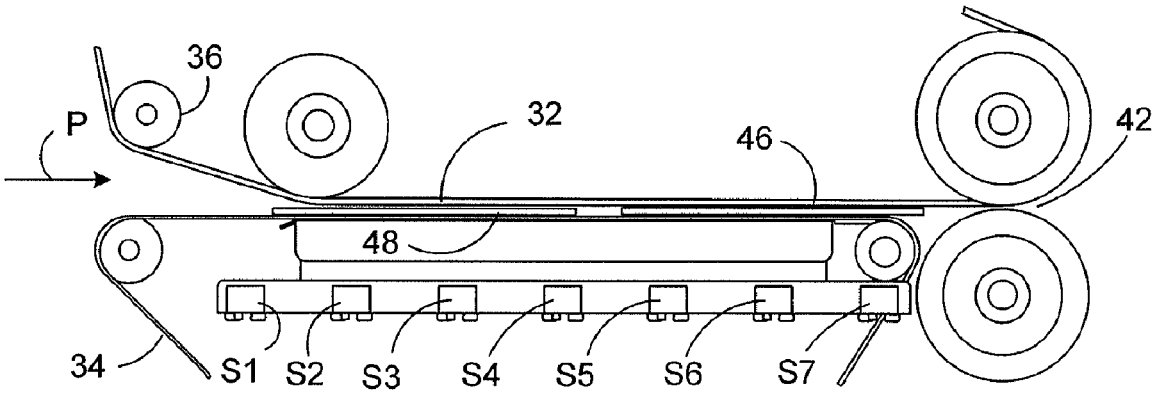

The method further comprises decreasing the second transport speed to singulate the overlapping items 46, 48, as shown in FIG. 3C. For example, slowing the speed of the second transport element 34 while maintaining the speed of the first transport element 32 causes the item 46 in contact with the first transport element 32 to move ahead of the overlapping item along the transport path P.

Figure 3D:
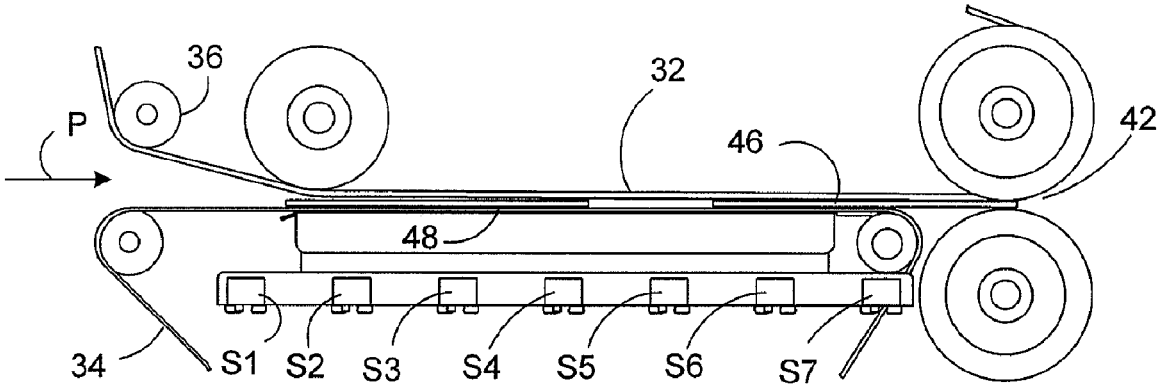

The method further comprises decreasing the first transport speed to reduce a speed of a lead item 46 and transporting the lead item 46 away from the singulation device 30, as shown in FIG. 3D. In one embodiment, transporting the lead item 46 away from the singulation device 30 comprises receiving the lead item 46 in the transport nip 42.

Figure 3E:
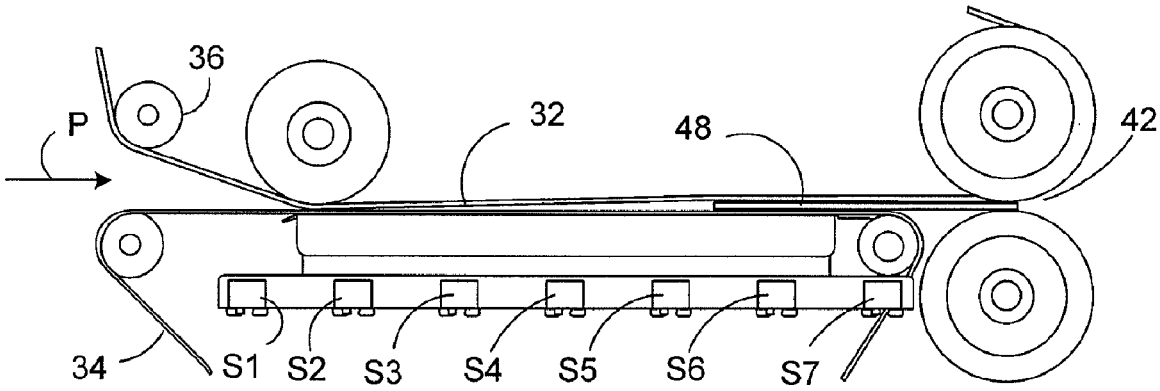

In one embodiment, the method further comprises increasing the first transport speed to advance a subsequent item 48 and transporting the subsequent item 48 away from the singulation device 30 at a predetermined pitch with respect to the lead item 46, as shown in FIG. 3E. In one embodiment, transporting the subsequent item 48 away from the singulation device 30 comprises receiving the subsequent item in the transport nip 42.

In a further embodiment of the method, decreasing the second transport speed comprises detecting a leading edge of the lead item with respective sensors and decreasing the second transport speed by a predetermined amount as each sensor detects the leading edge. As the leading edge of the lead item is detected by each successive sensor, the controller 19 adjusts the drive for the second transport element 34 to drive the second transport element 34 at a respective predetermined ratio of the first transport speed. In one embodiment, the drive (not shown) for the second transport element is geared to the drive (not shown) for the first transport element.

In one example, the sensors have the assigned ratios as set forth in Table 1. Other ratios may also be used.

TABLE 1

| Sensor | Ratio (%) |
|---|---|
| S1 | 100 |
| S2 | 100 |
| S3 | 60 |
| S4 | 25 |
| S5 | 15 |
| S6 | 10 |
| S7 | 0 |

In a further embodiment of the method, decreasing the second transport speed further comprises stopping the second transport element 34 on detection of the leading edge by the downstream sensor S7. Stopping the second transport element 34 is reflected in the table by the zero ratio associated with the downstream sensor S7. Thus, the second transport speed is substantially equal to the first transport speed until the leading edge of the lead item is detected by the sensor S3, at which point the second transport speed is reduced to 60 percent of the first transport speed. Reductions in the second transport speed are carried out in accordance with the assigned ratios until the second transport speed is reduced to zero when the leading edge is detected by the sensor S7.

The embodiment of the device shown in FIG. 2 and described with reference to Table 1 is merely exemplary. Other numbers and arrangements of sensors and other assigned ratios may also be used.

In another embodiment of the method, increasing the first transport speed to advance the subsequent item comprises detecting a position of the lead item, detecting a position of the subsequent item, computing a modified first transport speed based on the position of the lead item and the position of the subsequent item, and rotating the first transport element 32 at the modified first transport speed.

Thus, after the lead item has been transported away from the singulation device 30, its downstream position is tracked, such as with an encoder, for example. In addition, the position of the subsequent item is detected using a sensor. Based on the respective positions of the lead item and the subsequent item, the modified first transport speed is computed to provide the predetermined pitch between the lead item and the subsequent item. In one example, a pitch of approximately 25 inches is used. Pitches having other lengths may also be used.

In a further embodiment of the method, decreasing the first transport speed comprises stopping the first transport element 32 substantially simultaneously with transporting the lead item away from the singulation device 30. In one embodiment, stopping the first transport element 32 is carried out in response to detection by the nip sensor S8 that the lead item has been engaged by the transport nip 42.

In another embodiment, the method further comprises increasing the second transport speed substantially simultaneously with increasing the first transport speed to advance the subsequent item. In one embodiment, the second transport speed is increased based on a position of the subsequent item. For example, when the lead item is transported away from the singulation device 30, the controller determines the position of the subsequent item based on a detection by a respective sensor. Using the detected position, the controller drives the second transport element 34 at the ratio associated with the respective sensor.

For example, when the lead item is transported away from the singulation device 30, if the subsequent mailpiece is located at the position of the sensor S4, the controller drives the second transport at 25% of the first transport speed.

In yet another embodiment, the first transport speed is further modified based on an additional detection of the position of the leading edge of the subsequent item. This further modification may provide increased precision by utilizing the position of the leading edge of the subsequent item, as opposed to the detection by a sensor of an indeterminate portion of the subsequent item.

To illustrate using the above example, after the lead item is transported away from the singulation device 30, the first transport element 32 is driven at the modified first transport speed, as discussed above, and the second transport element 34 is driven at 25% of the first transport speed, based on the position detection of sensor S4. When the leading edge of the subsequent item is detected at sensor S5, a further modified first transport speed is computed to more accurately provide the predetermined pitch between the lead item and the subsequent item. Thus, the computation of the further modified first transport speed may be used to increase the precision of the pitch.

The method according to an embodiment of the invention further comprises decreasing the first transport speed to reduce a speed of the subsequent item prior to transporting the subsequent item away from the singulation device 30.

It will be apparent to those skilled in the art that various modifications and variations can be made to the structure and methodology described herein. Thus, it should be understood that the invention is not limited to the examples discussed in the specification. Rather, the present invention is intended to cover modifications and variations.

What is claimed is:

1. A method of singulating overlapping items, comprising:

receiving the overlapping items in a singulation device, wherein the singulation device comprises:

a first transport element configured for rotation in a first direction; and a second transport element in opposing relation to the first transport element and forming a transport path between the first and second transport elements, wherein the second transport element is configured for rotation in a second direction opposite to the first direction such that within the transport path both the first and second transport elements will provide a frictional force in a common direction to items in the transport path;

rotating the first transport element at a first transport speed;

rotating the second transport element at a second transport speed substantially equal to the first transport speed;

conveying the overlapping items between the transport elements along the transport path;

decreasing the second transport speed to singulate the overlapping items;

decreasing the first transport speed to reduce a speed of a lead item after it is singluated; and transporting the lead item away from the singulation device.

2. The method of claim 1, further comprising:

increasing the first transport speed to advance a subsequent item; and transporting the subsequent item away from the singulation device at a predetermined pitch with respect to the lead item.

3. The method of claim 2, wherein the singulation device further comprises a plurality of sensors, comprising at least an upstream sensor and a downstream sensor, arranged along the transport path for detecting a position of respective items.

4. The method of claim 3, wherein decreasing the second transport speed comprises:

detecting a leading edge of the lead item with respective sensors; and decreasing the second transport speed by a predetermined amount as each sensor detects the leading edge.

5. The method of claim 4, wherein decreasing the second transport speed further comprises stopping the second transport element on detection of the leading edge by the downstream sensor.

6. The method of claim 3, wherein increasing the first transport speed to advance the subsequent item comprises:

detecting a position of the lead item;

detecting a position of the subsequent item;

computing a modified first transport speed based on the position of the lead item and the position of the subsequent item; and rotating the first transport element at the modified first transport speed.

7. The method of claim 6, wherein detecting the position of the lead item comprises measuring the position of the lead item using an encoder.

8. The method of claim 6, wherein detecting the position of the subsequent item comprises detecting the position of the subsequent item using a sensor.

9. The method of claim 6, wherein the modified first transport speed is computed to provide the predetermined pitch between the lead item and the subsequent item.

10. The method of claim 2, wherein transporting the subsequent item away from the singulation device comprises receiving the subsequent item in a transport nip.

11. The method of claim 2, further comprising increasing the second transport speed substantially simultaneously with increasing the first transport speed to advance the subsequent item.

12. The method of claim 11, wherein the second transport speed is increased based on a position of the subsequent item.

13. The method of claim 2, further comprising decreasing the first transport speed to reduce a speed of the subsequent item prior to transporting the subsequent item away from the singulation device.

14. The method of claim 1, wherein decreasing the first transport speed comprises stopping the first transport element substantially simultaneously with transporting the lead item away from the singulation device.

15. The method of claim 1, wherein transporting the lead item away from the singulation device comprises receiving the lead item in a transport nip.

16. A method of singulating overlapping items, comprising:

receiving the overlapping items in a singulation device, wherein the singulation device comprises:

a first transport element configured for rotation in a first direction; and a second transport element in opposing relation to the first transport element and forming a transport path between the first and second transport elements, wherein the second transport element is configured for rotation in a second direction opposite to the first direction such that within the transport path both the first and second transport elements will provide a frictional force in a common direction to items in the transport path;

rotating the first transport element at a first transport speed;

rotating the second transport element at a second transport speed substantially equal to the first transport speed;

conveying the overlapping items between the transport elements along the transport path;

detecting a position of a leading edge of a lead item along the transport path;

decreasing the second transport speed based on the position of the leading edge to singulate the overlapping items;

decreasing the first transport speed to reduce a speed of the lead item after it is singulated;

transporting the lead item away from the singulation device;

increasing the first transport speed to a modified first transport speed based on the position of the lead item and a position of a subsequent item to advance the subsequent item;

decreasing the first transport speed to reduce a speed of the subsequent item; and transporting the subsequent item away from the singulation device at a predetermined pitch with respect to the lead item.

17. The method of claim 16, wherein the modified first transport speed is computed to provide the predetermined pitch between the lead item and the subsequent item.

18. The method of claim 16, further comprising increasing the second transport speed based on the position of the subsequent item substantially simultaneously with increasing the first transport speed to advance the subsequent item.

19. A device for singulating overlapping items, comprising:

a singulation device for receiving the overlapping items, wherein the singulation device comprises:

a first transport element configured for rotation in a first direction; and a second transport element in opposing relation to the first transport element and forming a transport path between the first and second transport elements, wherein the second transport element is configured for rotation in a second direction opposite to the first direction such that within the transport path both the first and second transport elements will provide a frictional force in a common direction to items in the transport path; and a controller operatively connected to the first transport element and the second transport element, the controller configured to:

rotate the first transport element at a first transport speed;

rotate the second transport element at a second transport speed substantially equal to the first transport speed, so as to convey the overlapping items between the transport elements along the transport path;

decrease the second transport speed to singulate the overlapping items;

decrease the first transport speed to reduce a speed of a lead item after it is singulated; and activate a transport nip to transport the lead item away from the singulation device.

20. The device of claim 19, wherein the controller is further configured to:

increase the first transport speed to advance a subsequent item; and activate the transport nip to transport the subsequent item away from the singulation device at a predetermined pitch with respect to the lead item.

21. The device of claim 20, wherein the singulation device further comprises a plurality of sensors, comprising at least an upstream sensor and a downstream sensor, arranged along the transport path for detecting a position of respective items.

22. The device of claim 21, wherein to decrease the second transport speed, the controller is configured to:

detect a leading edge of the lead item with respective sensors; and decrease the second transport speed by a predetermined amount as each sensor detects the leading edge.

23. The device of claim 22, wherein the controller is further configured to stop the second transport element on detection of the leading edge by the downstream sensor.

24. The device of claim 21, wherein to increase the first transport speed to advance the subsequent item, the controller is configured to:

detect a position of the lead item;

detect a position of the subsequent item;

compute a modified first transport speed based on the position of the lead item and the position of the subsequent item; and rotate the first transport element at the modified first transport speed.

25. The device of claim 24, wherein the modified first transport speed is computed to provide the predetermined pitch between the lead item and the subsequent item.

* * * * *